US011230112B2

(12) United States Patent
Janssen et al.

(10) Patent No.: US 11,230,112 B2
(45) Date of Patent: Jan. 25, 2022

(54) FLUID SUPPLY LEVELS BASED ON FLUID SUPPLY DEPRESSURIZATIONS

(71) Applicant: HEWLETT-PACKARD DEVELOPMENT COMPANY, L.P., Spring, TX (US)

(72) Inventors: Matthew J. Janssen, Corvallis, OR (US); James R. Cole, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 1 day.

(21) Appl. No.: 16/764,283

(22) PCT Filed: Jan. 25, 2018

(86) PCT No.: PCT/US2018/015183

§ 371 (c)(1),
(2) Date: May 14, 2020

(87) PCT Pub. No.: WO2019/147240

PCT Pub. Date: Aug. 1, 2019

(65) Prior Publication Data

US 2020/0361218 A1 Nov. 19, 2020

(51) Int. Cl.
*B41J 2/175* (2006.01)

(52) U.S. Cl.
CPC ..... *B41J 2/17556* (2013.01); *B41J 2/17566* (2013.01)

(58) Field of Classification Search
CPC ..... B41J 2/17556; B41J 2/17566; B41J 2/175
See application file for complete search history.

(56) References Cited

U.S. PATENT DOCUMENTS

| | | | |
|---|---|---|---|
| 6,036,296 | A | 3/2000 | Axteli et al. |
| 6,988,793 | B2 | 1/2006 | Wilson et al. |
| 9,452,613 | B2 | 9/2016 | Urabe |
| 2007/0151350 | A1 | 7/2007 | Sheldon |
| 2010/0220127 | A1 | 9/2010 | Levy |
| 2014/0104350 | A1 | 4/2014 | Urabe |
| 2017/0036452 | A1 | 2/2017 | Ge et al. |

FOREIGN PATENT DOCUMENTS

| | | | | |
|---|---|---|---|---|
| EP | 0840098 B1 | 12/2004 | | |
| GB | 0 840 098 A2 * | 5/1998 | ..... | B41J 2/175 |
| WO | WO-2010077387 A1 | 7/2010 | | |

OTHER PUBLICATIONS

Paxzesny, D. et al., The capacitive sensor for liquid level measurement made with ink-jet printing technology, 2015, http://www.sciencedirect.com/science/article/pii/S187770581502439X (5 pages).

* cited by examiner

*Primary Examiner* — Geoffrey S Mruk
(74) *Attorney, Agent, or Firm* — Trop Pruner & Hu PC

(57) ABSTRACT

In some examples, an apparatus includes a pressure sensor, and a controller to determine, based on pressure data from the pressure sensor, an amount of time to depressurize a fluid supply from a first pressure to a second pressure, and determine a level of a fluid in the fluid supply based on the amount of time to depressurize the fluid supply from the first pressure to the second pressure.

18 Claims, 4 Drawing Sheets

FLUID SUPPLY LEVELS BASED ON FLUID SUPPLY DEPRESSURIZATIONS

BACKGROUND

A printing system can include a printhead that has nozzles to dispense printing fluid to a target. In a two-dimensional (2D) printing system, the target is a print medium, such as a paper or another type of substrate onto which print images can be formed. Examples of 2D printing systems include inkjet printing systems that are able to dispense droplets of inks. In a three-dimensional (3D) printing system, the target can be a layer or multiple layers of build material deposited to form a 3D object.

BRIEF DESCRIPTION OF THE DRAWINGS

Some implementations of the present disclosure are described with respect to the following figures.

Figure 1:
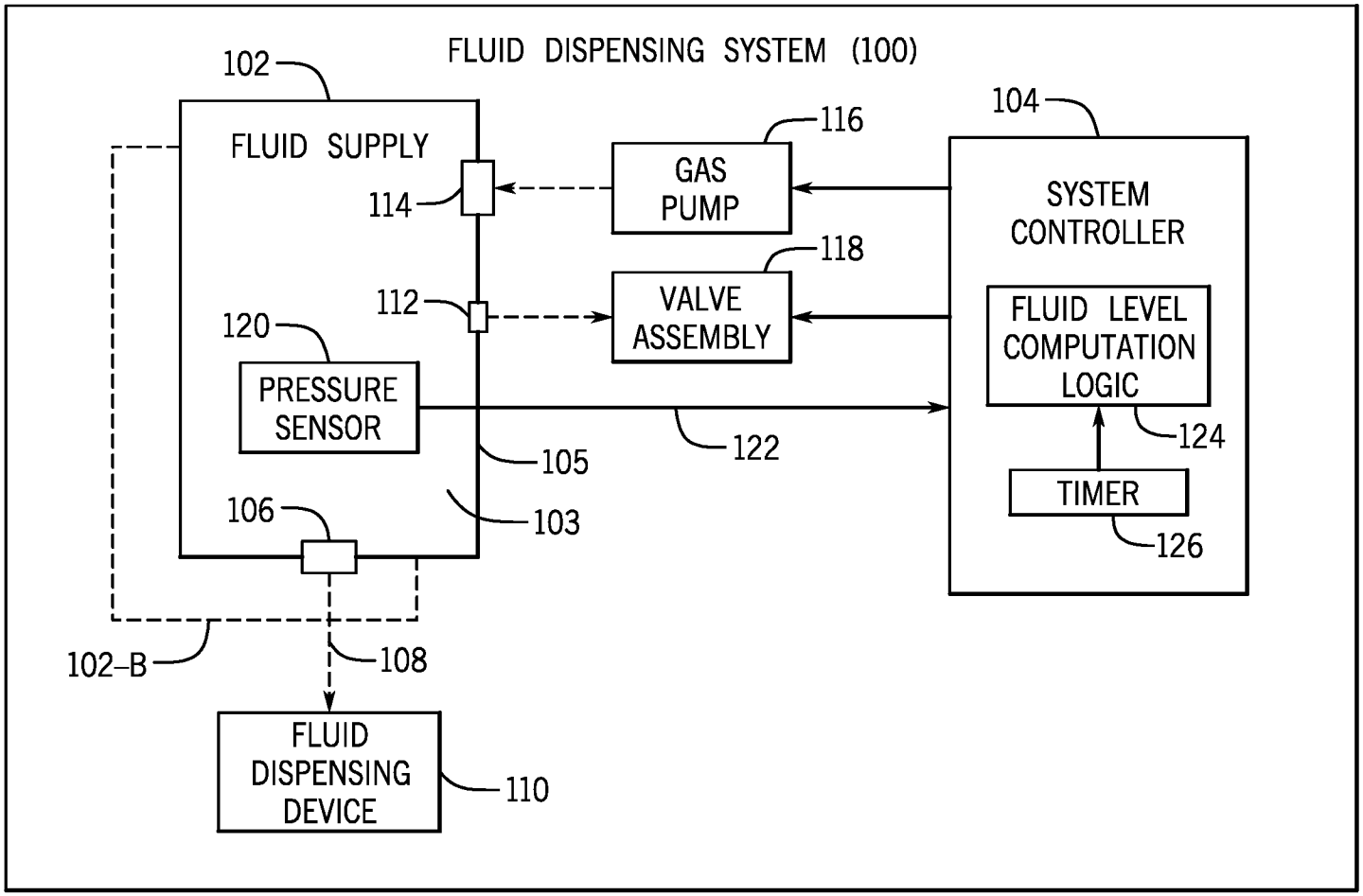
FIG. 1 is a block diagram of a fluid dispensing system according to some examples.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

In the present disclosure, use of the term "a," "an", or "the" is intended to include the plural forms as well, unless the context clearly indicates otherwise. Also, the term "includes," "including," "comprises," "comprising," "have," or "having" when used in this disclosure specifies the presence of the stated elements, but do not preclude the presence or addition of other elements.

A printing system can receive a printing fluid supply, or alternatively, multiple printing fluid supplies, that contain printing fluid(s) for use in printing onto a target.

A printing system can be a two-dimensional (2D) or three-dimensional (3D) printing system. A 2D printing system dispenses printing fluid, such as ink, to form images on print media, such as paper media or other types of print media. A 3D printing system forms a 3D object by depositing successive layers of build material. Printing fluids dispensed from the 3D printing system can include ink, as well as agents used to fuse powders of a layer of build material, detail a layer of build material (such as by defining edges or shapes of the layer of build material), and so forth.

Although reference is made to printing fluid supplies for use in printing systems in some examples, it is noted that techniques or mechanisms of the present disclosure are applicable to other types of fluid supplies used in fluid dispensing systems for non-printing applications. Examples of such other types of fluid dispensing systems include those used in fluid sensing systems, medical systems, vehicles, fluid flow control systems, and so forth.

As a fluid supply is used, the fluid in the fluid supply can become depleted. In some examples, a fluid level in the fluid supply can be based on counting a number of drops dispensed from a fluid dispensing device, such as a printhead. The number of drops can be used to estimate how much fluid has been used from the fluid supply. However, estimating a fluid level of a fluid supply based on counting drops can be inaccurate.

In other examples, a fluid level sensor can be used to determine a fluid level of a fluid supply. Such a fluid level sensor can be complex and can be associated with use of complex and expensive circuitry. Additionally, a fluid level sensor such as a pressure ink level sensor (PILS) provided in a printhead or other fluid dispensing device may not be accurate without calibration.

In accordance with some implementations of the present disclosure, a determination of a fluid level of a fluid supply can be based on a relatively simple system that includes a pressure sensor and a timing mechanism to measure an amount of time to depressurize the fluid supply from a first pressure to a second pressure different from the first pressure.

By determining a fluid supply level based on depressurizing a fluid supply, characteristics of a pump that is used to pressurize the fluid supply would not have to be first determined, since the time to depressurize the fluid supply is independent of the characteristics of the pump used to pressurize the fluid supply. By avoiding having to first characterize a pump to be able to use pressure data to estimate a fluid level of a fluid supply, the fluid supply level determination techniques or mechanisms according to some implementations of the present disclosure can be simplified. Also, the pressure measurement can be performed at a time when depressurizing of the fluid supply occurs anyway, minimizing the effect on the normal operation of a fluid dispensing system.

FIG. 1 is a block diagram of an example fluid dispensing system 100 that includes a fluid supply 102 and a system controller 104. In some examples, the fluid dispensing system 100 can be a printing system, and the fluid supply 102 can be a printing fluid supply. In other examples, the fluid dispensing system 100 can be a fluid dispensing system used in a non-printing application.

The system controller 104 can include a hardware processing circuit, such as any or some combination of the following: a microprocessor, a core of a multi-core microprocessor, a microcontroller, a programmable gate array, a programmable integrated circuit device, or any other type of hardware processing circuit. Alternatively, the system controller 104 can include a combination of a hardware processing circuit and machine-readable instructions executable on the hardware processing circuit.

The fluid supply 102 can be in the form of a cartridge or any other supply in the form of a tank, box, and so forth, to store a fluid. The fluid supply 102 can be removably mounted in the fluid dispensing system 100, such that the fluid supply 102 can be removed and either re-inserted or replaced with a different fluid supply. In such examples, the fluid dispensing system 100 can be provided to an end user without the fluid supply 102. Once the end user receives the fluid dispensing system 100, the end user can install the fluid supply 102 in the system 100. If the fluid in the fluid supply 102 becomes depleted, the fluid supply 102 can be removed. The removed fluid supply can be refilled and then installed back in the fluid dispensing system 100, or alternatively, a new fluid supply can be installed in the fluid dispensing system 100 after removal of the depleted fluid supply 102.

In other examples, the fluid supply 102 can be fixedly mounted in the fluid dispensing system 100. If the fluid supply 102 becomes depleted, the fluid supply 102 can be refilled with a fluid.

In FIG. 1, the fluid supply 102 includes a fluid reservoir 103 contained within a housing 105 of the fluid supply 102. The fluid reservoir 103 holds a fluid that can be dispensed through an outlet 106 (or alternatively, multiple outlets 106) along a path indicated by arrow 108.

The fluid in the fluid reservoir 103 can exit the outlet(s) 106 for dispensing to a fluid dispensing device 110 of the fluid dispensing system 100. In some examples, the fluid dispensing device 110 can include a pen (printhead). In further examples, the fluid dispensing device 110 can be a different type of fluid dispensing device that controls a flow of fluid.

Although FIG. 1 shows dispensing of fluid downwardly from the fluid supply 102, it is noted that in other example, fluid can be dispensed from the fluid supply 102 in a different direction.

The fluid dispensing system 100 has a fluid supply mounting structure (not shown) onto which the fluid supply 102 can be installed. In some examples, the mounting structure includes a carriage that is movable within the fluid dispensing system 100 to move the mounted fluid supply 102 to different locations for dispensing fluid onto a target at those locations. In other examples, the mounting structure can be fixed in position.

In a 3D printing operation, a target onto which a printing fluid can be dispensed by the fluid dispensing device 110 can include a 3D object that is formed with successive layers. In a 2D printing operation, the target can include a print medium, such as paper, plastic, and so forth. In non-printing applications, the target can refer to any object or location onto or toward which fluid is to be directed.

The fluid supply 102 also has a gas port 114 (or multiple gas ports 114) that is (are) formed in the housing 105 of the fluid supply 102. The gas port 114 can be connected to receive a gas from a gas pump 116. In some examples, the gas received through the gas port 114 includes air. In other examples, other types of gas can be pumped by the gas pump 116 into the fluid supply 102 through the gas port 114. The gas pump 116 can be operated under control of the system controller 104.

The gas pump 116 can pump gas into the fluid supply 102 to a first pressure, which provides a pressure to the fluid in the reservoir 103. The pressure urges the fluid in the reservoir 103 to flow through the outlet 106 to the fluid dispensing device 110. The pressure can be maintained by the gas pump 116 during a fluid dispensing operation of the fluid dispensing system 100. In examples where the fluid dispensing system 100 is a printing system, the pressure can be applied during a printing operation of the printing system in which the printhead (an example of the fluid dispensing device 110) is dispensing fluid onto a target.

The fluid supply 102 also includes a gas outlet 112, to allow gas to be removed from the inside of the fluid supply 102. In other examples, instead of forming the gas outlet 112 in the housing 105 of the fluid supply 102, the gas outlet 112 can instead be provided in a gas conduit (e.g., a gas line) between the gas port 114 and the gas pump 116.

In some examples, the gas outlet 112 (or alternatively, multiple gas outlets 112) can provide a fixed leak path for the gas inside the fluid supply 102, such that the gas inside the fluid supply 102 can escape through the gas outlet(s) 112 at a relatively slow rate while the gas pump 116 is off (i.e., is not pumping gas into the fluid supply 102). The gas outlet(s) 112 can be coupled to a valve assembly 118, which can be controlled by the system controller 104. The valve assembly 118 can include a valve (or multiple valves) that can control whether or not gas is allowed to exit from the fluid supply 102 through the gas outlet(s) 112. When a valve (or multiple valves) in the valve assembly 118 is (are) closed, gas cannot escape from the fluid supply 102 through the gas outlet(s) 112. If the valve(s) of the valve assembly 118 is (are) opened, then gas is allowed to escape through the gas outlet(s) 112.

The valve assembly 118 can be actuated by the system controller 104 to open the valve(s) to depressurize the fluid supply 102 from the first pressure (as pressurized by the gas pump 116) to a different second pressure, where the second pressure can be an atmospheric pressure corresponding to the atmosphere of the fluid dispensing system 100. In other examples, the second pressure can be a different target pressure to which the fluid supply 102 is to be depressurized. The fluid in the fluid supply 102 can be pressurized in order to make sure that all, or nearly all, of the available fluid in the fluid supply 102 is provided to the fluid dispensing device 110. To do so, the fluid flow has to overcome mechanical resistance in a bag and tubes or other conduits, and further, the fluid may have to be forced up an incline, for example. Depressurization of the fluid supply 102 may be performed when the fluid supply 102 is not actively being used.

The fluid supply 102 further includes a pressure sensor 120. In some examples, the pressure sensor 120 can be mounted inside the fluid supply 102 or mounted on an external wall of the fluid supply 102, with the pressure sensor 120 being in communication with a gas chamber inside the fluid supply 102 to measure the gas pressure inside the fluid supply 102. In other examples, the pressure sensor 120 can be coupled to a gas conduit (such as to a bleed valve) connected to a gas outlet 112, to measure the pressure inside the gas outlet conduit.

Pressure measurement data acquired by the pressure sensor 120 represents either the pressure inside the fluid supply 102 or in the gas outlet conduit connected to a gas outlet 112. The pressure measurement data acquired by the pressure sensor 120 can be provided over a link 122 to the system controller 104. The link 122 can include an electrical conductor (or multiple electrical conductors).

In some examples, the fluid supply 102 can include electrically conductive pads that can be connected to electrical conductors for establishing communication between the pressure sensor 120 and the system controller 104. Alternatively, the fluid supply 102 can have a connector that can be connected to a mating connector of the system controller 104 or a circuit board on which the system controller 104 is mounted.

Alternatively, the pressure sensor 120 can wirelessly transmit the pressure measurement data to the system controller 104.

Although just one pressure sensor 120 is depicted in FIG. 1, it is noted that in other examples, multiple pressure sensors can be provided, to measure pressure at different locations, such as inside the fluid supply 102, inside a gas outlet conduit or multiple gas outlet conduits, and so forth. In examples where multiple pressure sensors are provided, the pressure measurement data from the multiple pressure sensors can be aggregated (e.g., averaged) to produce an aggregate measurement data that can be processed by the system controller 104.

The system controller 104 includes a fluid level computation logic 124 to compute, based on pressure measurement data from the pressure sensor 120, a fluid level of a fluid in the reservoir 103 of the fluid supply 102. In some examples, the fluid level computation logic 124 is part of the hardware processing circuit of the system controller 104. In other examples, the fluid level computation logic 124 can be implemented as machine-readable instructions executable by the system controller 104.

The system controller 104 also includes a timer 126, which can measure elapsed time. The timer 126 can be a hardware timer or a timer implemented using machine-readable instructions. The fluid level computation logic 124 receives timing signals from the timer 126 to determine an amount of time taken to depressurize the fluid supply 102 from the first pressure to the second pressure, where the depressurization is accomplished by allowing the gas inside the fluid supply 102 to escape through the gas outlet(s) 112.

The fluid level computation logic 124 can receive pressure measurement data from the pressure sensor 120 acquired at different times, and can correlate the received pressure measurement data to different time instants corresponding to timing signals from the timer 126. Using the collected pressure measurement data over time, the fluid level computation logic 124 can determine when the pressure of the fluid supply 102 has dropped to the second pressure, and the time instant corresponding to when the pressure of the fluid supply 102 has dropped to the second pressure. The time difference between the time instant at which the pressure of the fluid supply 102 has reached the second pressure and the time instant at which the pressure of the fluid supply 102 was at the first pressure can be used to estimate the fluid level of the fluid supply 102.

In further examples, the fluid dispensing system 100 may include a second fluid supply 102-B, which can perform a fluid dispensing operation in the fluid dispensing system 100 while the system controller 104 determines the level of the fluid in the first fluid supply 102 based on the amount of time to depressurize the fluid supply from the first pressure to a second pressure. The second fluid supply 102-B may also be used to allow the first fluid supply 102 to be changed out without stopping operation of the fluid dispensing system 100.

Figure 2:
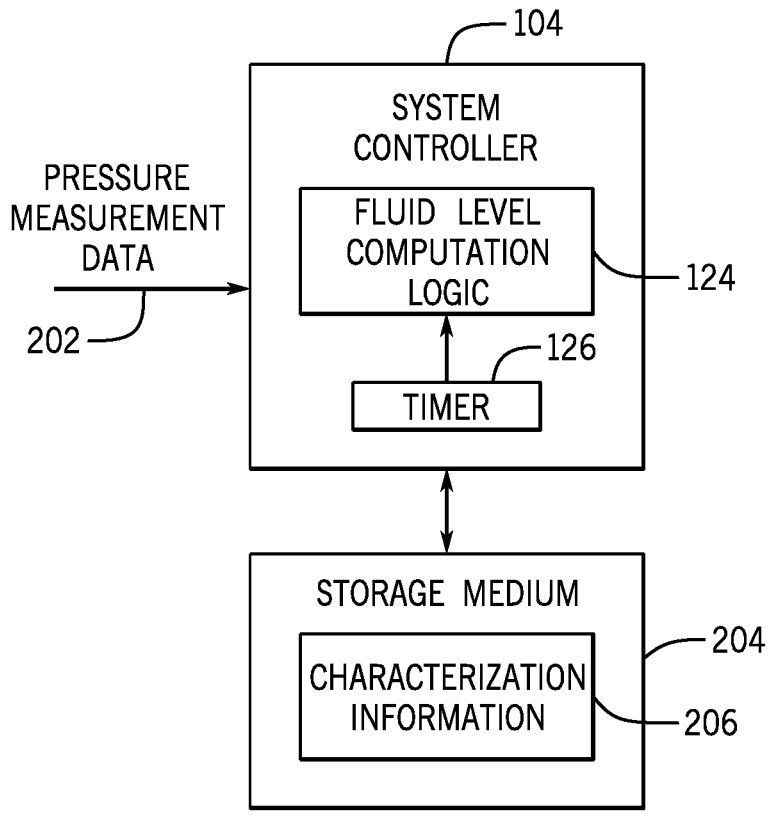
FIGS. 2 and 3 are block diagrams of arrangements including system controllers for estimating fluid supply levels according to various examples.

FIG. 2 is a block diagram of an example arrangement according to further implementations. In FIG. 2, the system controller 104 that includes the fluid level computation logic 124 receives pressure measurement data 202 from the pressure sensor 120 (FIG. 1). The system controller 104 is coupled to a storage medium 204, which can be implemented using a storage device or multiple storage devices. A storage device can include a volatile memory device, a non-volatile memory device, a persistent disk-based storage device, or any other type of storage device.

The storage medium 204 stores characterization information 206 that correlates different depressurization times to respective different fluid supply levels. In some examples, the characterization information 206 can be in the form of a lookup table that has multiple entries. Each entry of the lookup table includes a respective depressurization time (the amount of time to depressurize from the first pressure to the second pressure) and the corresponding fluid level of the fluid supply 102 that corresponds to the respective depressurization time. The different entries include different depressurization times and corresponding different fluid levels.

In examples according to FIG. 2, once the fluid level computation logic 124 has computed, based on the pressure measurement data 202 and the timing signals from the timer 126, the depressurization time to depressurize the fluid supply 102 from the first pressure to the second pressure, the fluid level computation logic 124 can access the characterization information 206 to retrieve the fluid level corresponding to the computed depressurization time. For example, the computed depressurization time can be used to look up an entry of a lookup table—the selected entry of the lookup table includes the fluid level corresponding to the computed depressurization time.

The characterization information 206 can be pre-loaded into the storage medium 204. For example, an entity (such as a manufacturer, a user, etc.) can perform a test procedure to measure different depressurization times for different fluid levels of the fluid supply 102. During the test, the entity can place a fluid supply having a first fluid level in a fluid dispensing system, and can measure the amount of time to depressurize from the first pressure to the second pressure. The entity can then place the fluid supply having a second fluid level in a fluid dispensing system, and can measure the amount of time to depressurize from the first pressure to the second pressure. The foregoing process can be repeated for other fluid levels in the test procedure. The test procedure produces the characterization information 206 that can then be stored into the storage medium 204.

In other examples, the system controller 104 is able to produce the characterization information 206, by performing a test procedure in the fluid dispensing system 100, such as after the fluid dispensing system 100 has already been delivered to an end user, or alternatively, at another location in a distribution stream of the fluid dispensing system 100. For example, a user of the fluid dispensing system 100 can install fluid supplies with different known fluid levels into the fluid dispensing system 100, and can instruct the system controller 104 to perform depressurization from the first pressure to the second pressure for each of the fluid supplies with known fluid levels. Based on such tests, the system controller 104 can produce the characterization information 206.

Figure 3:
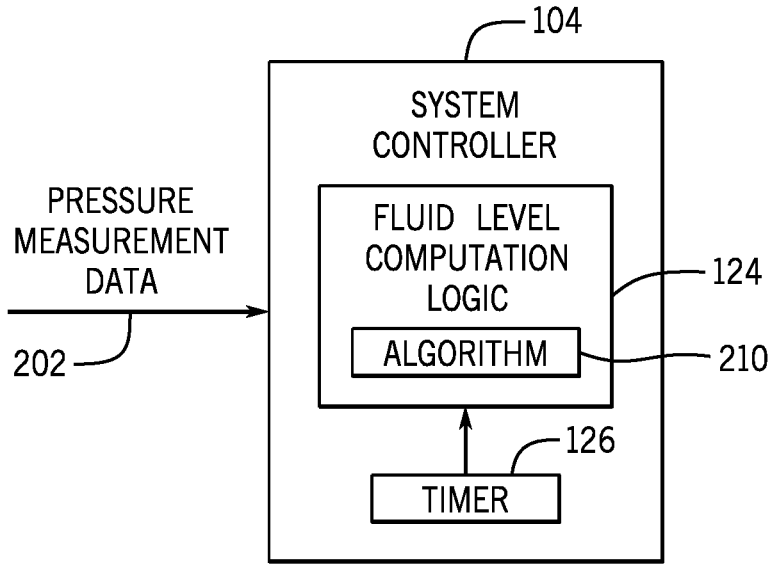

FIG. 3 is a block diagram of an alternative arrangement that includes the system controller 104. In FIG. 3, the fluid level computation logic 124 uses an algorithm 210 that is programmed into the fluid level computation logic 124, to calculate a fluid level of the fluid supply 102 based on a determined depressurization time to depressurize from the first pressure to the second pressure. The algorithm 210 can be in the form of an equation that is programmed into the fluid level computation logic 124, for example. The determined depressurization time is input into the algorithm 210, which then computes the corresponding fluid supply level.

Figure 4:
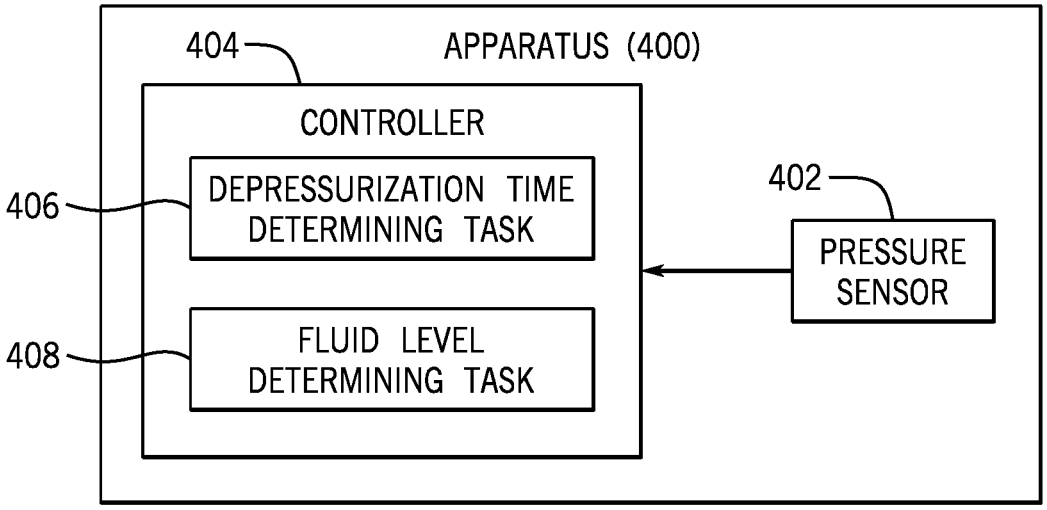
FIG. 4 is a block diagram of an apparatus according to further examples.

FIG. 4 is a block diagram of an apparatus 400 that includes a pressure sensor 402 and a controller 404 to perform various tasks. The tasks performed by the controller 404 include a depressurization time determining task 406 to determine, based on pressure data from the pressure sensor 402, an amount of time to depressurize a fluid supply from a first pressure to a second pressure. The tasks further include a fluid level determining task 408 to determine a level of a fluid in the fluid supply based on the amount of time to depressurize the fluid supply from the first pressure to the second pressure.

Figure 5:
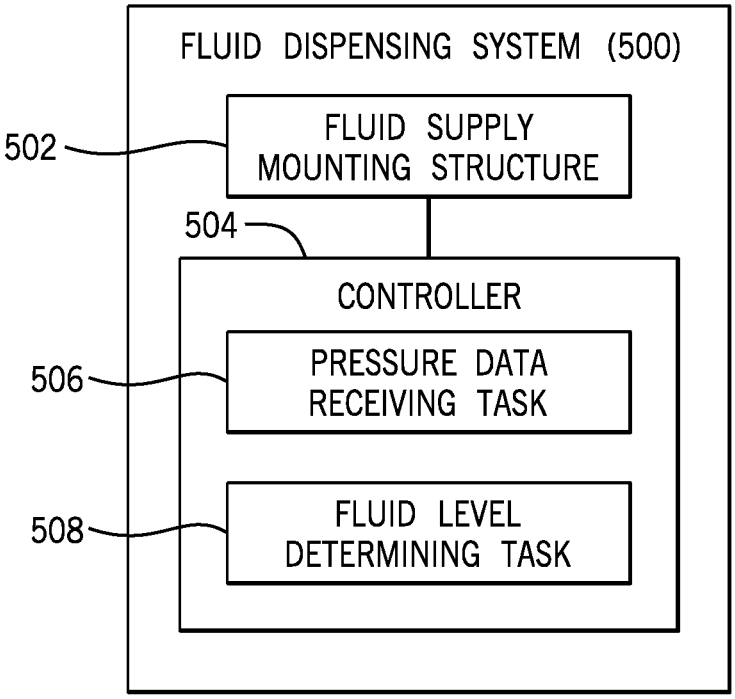
FIG. 5 is a block diagram of a fluid dispensing system according to other examples.

FIG. 5 is a block diagram of a fluid dispensing system 500 that includes a fluid supply mounting structure 502 (e.g., a carriage) on which a fluid supply is mounted. The fluid dispensing system 500 further includes a controller 504 to perform various tasks. The tasks performed by the controller 504 include a pressure data receiving task 506 to receive pressure data from a pressure sensor, the pressure data relating to depressurization of the fluid supply mounted to the fluid supply mounting structure 502. The tasks further include a fluid level determining task 508 to determine a level of a fluid in the fluid supply based on an amount of time to depressurize the fluid supply from a first pressure to a second pressure.

The determining of the level of the fluid in the fluid supply based on the amount of time to depressurize the fluid supply from the first pressure to the second pressure can be performed during an operation of the fluid dispensing system 500. In examples where the fluid dispensing system 500 is a printing system, the determining of the level of the fluid in the fluid supply based on the amount of time to depressurize the fluid supply from the first pressure to the second pressure is performed during a print operation of the printing system that prints fluid from the fluid supply.

In some examples, the tasks of the controller 404 (FIG. 4) or 504 (FIG. 5) can be performed by machine-readable instructions executed on a hardware processing circuit of the system controller 404 or 504. The machine-readable instructions can be stored on a non-transitory machine-readable or computer-readable storage medium.

Figure 6:
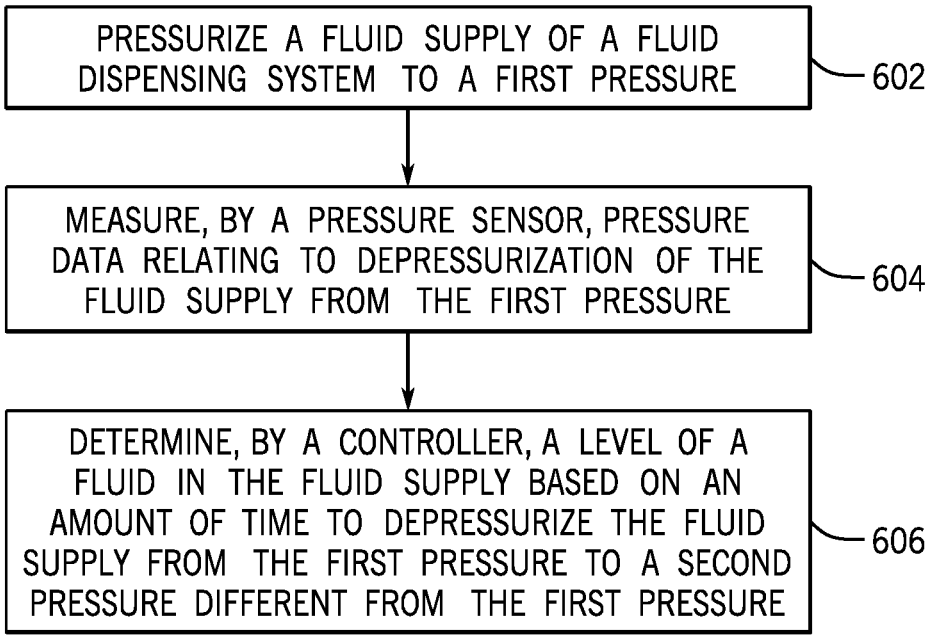
FIG. 6 is a flow diagram of a process in a fluid dispensing system according to further examples.

FIG. 6 is a flow diagram of an example process that can be performed by a fluid dispensing system. The process pressurizes (at 606) a fluid supply of the fluid dispensing system to a first pressure, such as by activating the gas pump 116 by the system controller 104 of FIG. 1.

The process measures (at 604), by a pressure sensor, pressure data relating to depressurization of the fluid supply from the first pressure. The process determines (at 606), by a controller, a level of a fluid in the fluid supply based on an amount of time to depressurize the fluid supply from the first pressure to a second pressure different from the first pressure.

In the foregoing description, numerous details are set forth to provide an understanding of the subject disclosed herein. However, implementations may be practiced without some of these details. Other implementations may include modifications and variations from the details discussed above. It is intended that the appended claims cover such modifications and variations.

What is claimed is:

1. A printing system comprising:
a pressure sensor; and
a controller to:
determine, based on pressure data from the pressure sensor, an amount of time to depressurize a fluid supply from a first pressure to a second pressure, and
determine a level of a fluid in the fluid supply based on the amount of time to depressurize the fluid supply from the first pressure to the second pressure during a print operation of the printing system that prints fluid from the fluid supply to a target.

2. The printing system of claim 1, wherein to determine the level of the fluid in the fluid supply, the controller is to access characterization information that correlates different depressurization times to respective different fluid supply levels.

3. The apparatus printing system of claim 2, further comprising:
a storage medium to store the characterization information.

4. The printing system of claim 1, wherein to determine the level of the fluid in the fluid supply, the controller is to calculate the level of the fluid in the fluid supply based on inputting the amount of time into an algorithm.

5. The printing system of claim 1, wherein the amount of time to depressurize the fluid supply from the first pressure to the second pressure is between a first time instant when the fluid supply has been pressurized to the first pressure by pumping, using a pump, a gas into the fluid supply, and a second time instant when the fluid supply has depressurized to the second pressure.

6. The printing system of claim 5, wherein the depressurizing of the fluid supply is through a gas outlet port of the fluid supply while the pump is off.

7. The printing system of claim 1, wherein the pressure sensor is to measure a pressure in the fluid supply.

8. A printing system comprising:
a mounting structure to mount a fluid supply; and
a controller to:
receive pressure data from a pressure sensor, the pressure data relating to depressurization of the fluid supply;
determine a level of a fluid in the fluid supply based on an amount of time to depressurize the fluid supply from a first pressure to a second pressure during a print operation of the printing system that prints fluid from the fluid supply to a target.

9. The printing system of claim 8, further comprising:
the fluid supply,
wherein the fluid supply has a gas outlet port through which gas is to flow as the fluid supply is depressurized.

10. The printing system of claim 8, wherein the controller is to compute characterization information for the fluid supply, the characterization information correlating different depressurization times of the fluid supply to respective different fluid supply levels.

11. The printing system of claim 10, wherein the controller is to access the characterization information based on the amount of time to depressurize the fluid supply from the first pressure to the second pressure, and to determine the level of the fluid in the fluid supply based on accessing the characterization information.

12. The printing system of claim 11, wherein the controller is to store the characterization information in a storage medium.

13. The printing system of claim 11, wherein the characterization information comprises a lookup table.

14. A method comprising:
pressurizing a fluid supply of a printing system to a first pressure;
measuring, by a pressure sensor, pressure data relating to depressurization of the fluid supply from the first pressure; and
determining, by a controller, a level of a fluid in the fluid supply based on an amount of time to depressurize the fluid supply from the first pressure to a second pressure different from the first pressure during a print operation of the printing system that prints fluid from the fluid supply to a target.

15. The method of claim 14, wherein the pressurizing of the fluid supply uses a gas pump.

16. The method of claim 14, controlling, by the controller, a valve assembly to depressurize the fluid supply from the first pressure to the second pressure.

17. The method of claim 14, wherein determining the level of the fluid in the fluid supply based on the amount of time to depressurize the fluid supply from the first pressure to the second pressure is based on accessing characterization information that correlates different depressurization times to respective different fluid supply levels.

18. The method of claim 17, wherein the characterization information comprises a lookup table.

* * * * *